US010588394B2

(12) United States Patent
Prade et al.

(10) Patent No.: US 10,588,394 B2
(45) Date of Patent: Mar. 17, 2020

(54) COSMETIC APPLICATOR

(71) Applicant: L'OREAL, Paris (FR)

(72) Inventors: Pauline Prade, Clichy (FR); Alain Berhault, Clichy (FR); Eric Caulier, Clichy (FR)

(73) Assignee: L'OREAL, Paris (FR)

( * ) Notice: Subject to any disclaimer, the term of this patent is extended or adjusted under 35 U.S.C. 154(b) by 174 days.

(21) Appl. No.: 15/541,680

(22) PCT Filed: Jan. 5, 2016

(86) PCT No.: PCT/EP2016/050085
§ 371 (c)(1),
(2) Date: Jul. 5, 2017

(87) PCT Pub. No.: WO2016/110490
PCT Pub. Date: Jul. 14, 2016

(65) Prior Publication Data

US 2018/0020806 A1 Jan. 25, 2018

(30) Foreign Application Priority Data

Jan. 5, 2015 (FR) ..... 15 50028

(51) Int. Cl.
*A45D 34/04* (2006.01)
*A46B 9/08* (2006.01)
(Continued)

(52) U.S. Cl.
CPC ..... *A45D 34/04* (2013.01); *A45D 34/042* (2013.01); *A45D 40/20* (2013.01); *A45D 40/26* (2013.01);
(Continued)

(58) Field of Classification Search
CPC ..... A45D 2200/1072; A45D 34/04; A45D 34/042; A45D 40/26; A45D 40/262
(Continued)

(56) References Cited

U.S. PATENT DOCUMENTS 2,901,100 A 8/1959 Mueller et al.
8,286,649 B2 * 10/2012 Gueret ..... A45D 34/045 132/320
(Continued)

FOREIGN PATENT DOCUMENTS

FR 1410688 A 9/1965
JP S57-34487 † 2/1982
(Continued)

OTHER PUBLICATIONS

Feb. 8, 2016 International Search Report issued in International Patent Application No. PCT/EP2016/050085.
(Continued)

*Primary Examiner* — Jennifer C Chiang
(74) *Attorney, Agent, or Firm* — Oliff PLC

(57) ABSTRACT

Cosmetic applicator comprising an application member having a base fixed to a support, this base extending along a longitudinal axis of the support, and an applicator part connected to the base, the applicator comprising a constraint element (30) attached to the application member and at least partially in contact with the latter, the constraint element (30) constraining the application member in such a way that the applicator part extends at least partially obliquely with respect to the axis of the support.

19 Claims, 2 Drawing Sheets

Figure 1:
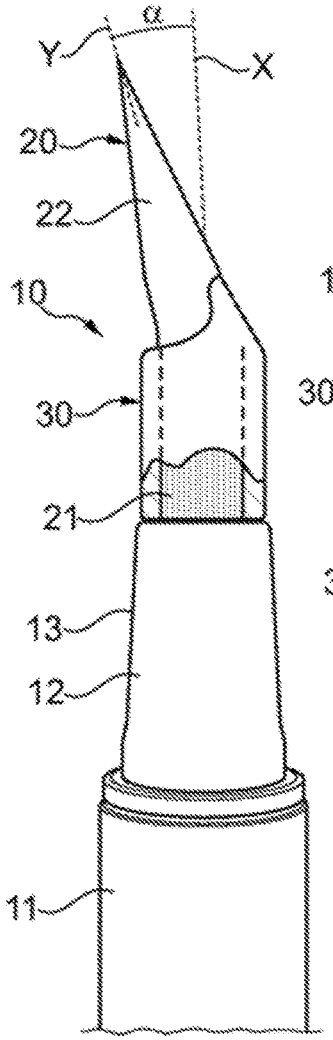

(51) Int. Cl.
*A46B 9/02* (2006.01)
*A45D 40/20* (2006.01)
*A45D 40/26* (2006.01)

(52) U.S. Cl.
CPC ..... *A45D 40/262* (2013.01); *A46B 9/021* (2013.01); *A46B 9/08* (2013.01); *A45D 2200/1072* (2013.01); *A46B 2200/1046* (2013.01)

(58) Field of Classification Search
USPC ..... 401/198
See application file for complete search history.

(56) References Cited

U.S. PATENT DOCUMENTS

2012/0207533 A1† 8/2012 Liu
2013/0051894 A1* 2/2013 Lim ..... A45D 40/20 401/88
2017/0251787 A1* 9/2017 Kudo ..... A45D 34/042
2018/0070701 A1* 3/2018 Evain ..... A45D 34/04
2018/0140072 A1* 5/2018 Chen ..... A45D 34/04

FOREIGN PATENT DOCUMENTS

JP 2003-039877 A 2/2003
JP 3193469 U † 10/2014
WO 2006/022726 A1 3/2006
WO 2012/168874 A1 12/2012

OTHER PUBLICATIONS

Jul. 11, 2017 International Preliminary Report on Patentability issued in International Patent Application No. PCT/EP2016/050085.

* cited by examiner
† cited by third party

COSMETIC APPLICATOR

The present invention relates to applicators for applying a cosmetic product to human keratinous substances and more particularly, but not exclusively, to eyeliner applicators.

Eyeliner applicators generally comprise a felt tip which is fixed to the end of a stem or is carried by a pen body. This felt tip most often extends along a rectilinear longitudinal axis coincident with the longitudinal axis of the stem or of the pen body.

However, an applicator tip of this shape is not always satisfactory for applying makeup to the eyelids, especially when the user is self-applying makeup in front of a mirror, there being a possibility of the applicator obstructing part of the field of view and thus making the procedure more awkward and less precise.

The publication WO2006/022726 describes an eyeliner applicator in which the applicator part is curved.

There is a need to facilitate the production of an applicator in which the applicator tip does not extend along a rectilinear longitudinal axis.

The invention responds to this need with a cosmetic applicator comprising an application member having a base fixed to a support, this base extending along a longitudinal axis of the support, and an applicator part connected to the base, the applicator comprising a constraint element fitted to the application member and at least partially in contact with the latter, the constraint element constraining the application member in such a way that the applicator part extends at least partially obliquely with respect to the axis of the support.

By virtue of the invention, it is relatively easy to give the applicator part the desired angle by exerting greater or lesser constraint on the application member using the constraint element.

The application member can be constrained to a greater or lesser extent through the choice of the shape of the constraint element, which means that one and the same application member can be used to produce several different applicators, by virtue of corresponding attached constraint elements.

The constraint element can be carried exclusively by the application member. Alternatively, the constraint element is fixed at least partially to the support of the application member. The constraint element can be made in one piece with a tubular body forming a reservoir.

The constraint element can be retained by a guide. The latter may not come into contact with the application member.

The guide can be formed in one piece with a tubular body forming a reservoir.

The guide can thus have a bent shape and can be connected, forming a non-zero angle, to a tubular part which accommodates the product reservoir and can define a pen body. The guide can be made in one piece with the pen body.

The shape of the guide can be such that it would already constrain the application member, causing the latter to curve, in the absence of the constraint element, that is to say before the latter is fitted in the guide.

The application member can have a recess, for example in the form of an annular groove, facilitating the curvature of the applicator tip.

The constraint element can have at least one rib helping to hold the application member, better still several ribs.

The application member is advantageously a felt tip.

The application member can have a rectilinear longitudinal axis before the constraint element is fitted.

The application member can also have a shape without rotational symmetry, or alternatively a shape with rotational symmetry, before the constraint element is fitted.

A shape without rotational symmetry can make it easier to deform the application member but may require fitting at an angle.

By contrast, a shape with rotational symmetry can be fitted without identification of the orientation.

The constraint element can be fixed relative to the application member. Alternatively, the constraint element is movable relative to the application member. This can allow the inclination of the applicator part relative to its support to be varied.

The movement of the constraint element relative to the application member can then take place between at least two positions in which the constraint element forms part of the applicator, conferring two different respective orientations on the applicator part.

The constraint element can comprise a tubular fitting part and a bearing element extending toward the axis of the tubular fitting part.

The constraint element can be moulded in one piece from thermoplastic material.

The axis of the applicator part can form an angle of between 10 and 20° with the axis of the support.

A further subject of the invention is a device for packaging and applying a cosmetic product, preferably eyeliner, comprising:

- an applicator according to the invention, as defined above,
- a container containing the product to be applied with the aid of the applicator.

The container can be formed by a pen body carrying the application member.

A further subject of the invention is a method for producing an applicator according to the invention, comprising the step of deforming the application member with the aid of the constraint element in such a way as to cause the applicator part to extend in a direction other than the one in which it extends before the constraint element is fitted.

Figure 3:
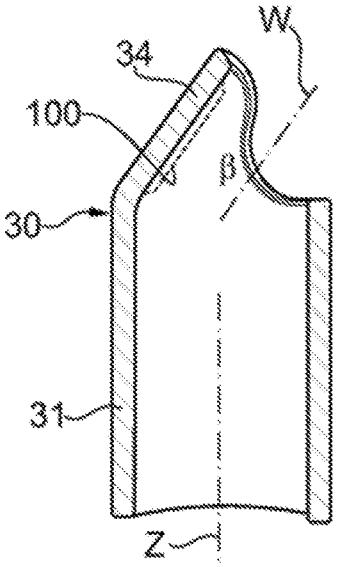
Figure 2:
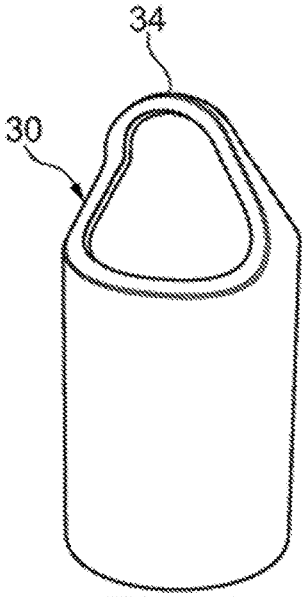
Figure 8:
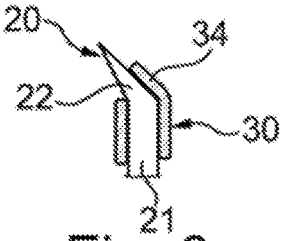
Figure 9:
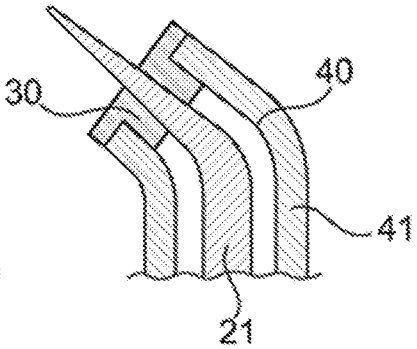
Figure 7A:
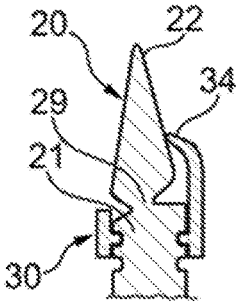
Figure 7B:
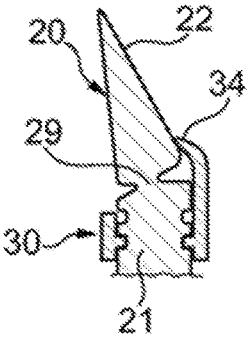
Figure 6A:
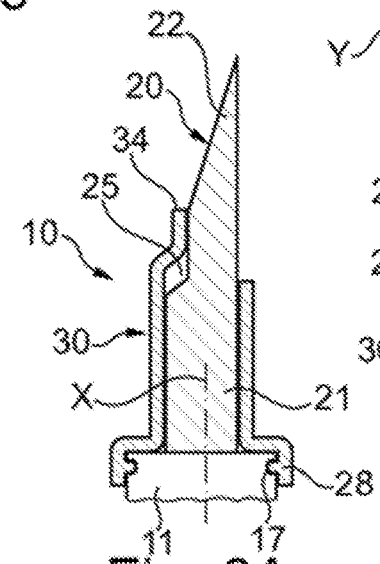
Figure 6B:
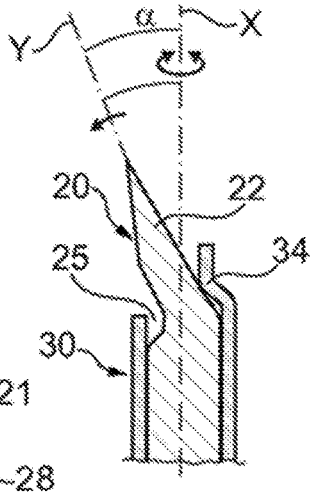
Figure 4:
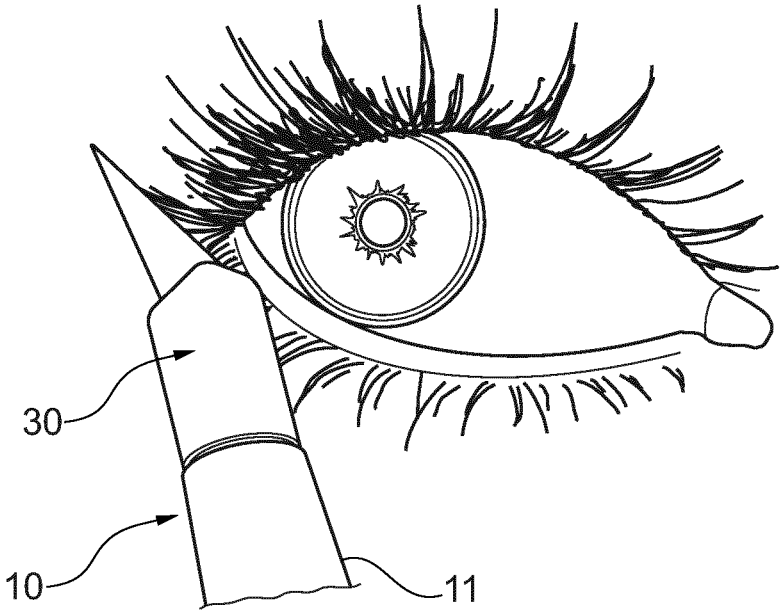
Figure 5:
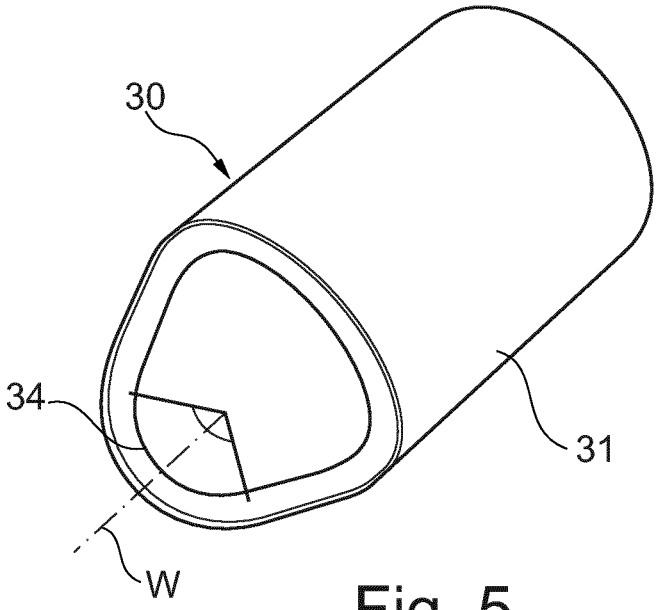

The invention may be better understood from reading the following detailed description of non-limiting illustrative embodiments thereof and from examining the appended drawing, in which:

FIG. 1 is a schematic perspective view of an applicator produced according to the invention, FIGS. 2 and 5 show the constraint element of the applicator from FIG. 1 on its own and seen at two different angles, FIG. 3 is an axial section through the element from FIG. 2, FIG. 4 illustrates how the applicator from FIG. 1 is used to apply makeup to the eyelid, FIGS. 6A and 6B are two schematic and partial views of an alternative embodiment of the applicator, in which the constraint element is movable in rotation relative to the applicator part, FIGS. 7A and 7B are two views similar to FIGS. 6A and 6B and in which the constraint element is movable axially relative to the application member, and FIGS. 8 and 9 are partial longitudinal sections through alternative embodiments of applicators.

The applicator 10 shown in FIG. 1 comprises a pen body 11, which serves as a gripping member and on which is mounted an application member 20 comprising a base 21, fixed in the pen body, and an applicator part 22 connected to the base 21.

In the example in question, the application member 20 is a felt tip, the base 21 being integrally joined to the applicator part 22.

The felt tip is supplied with product from the interior of the body 11, which forms a container, by virtue of the ability of the fibres of the application member 20 to transport the product by capillary action as far as the applicator part 22.

When not in use, the pen body 11 can be closed by a closure cap (not shown) which, for example, engages with a snap fit onto a relief 13 at the end region 12 of the pen body 11.

In the example shown, the base 21 extends along a longitudinal axis X, which is coincident with the longitudinal axis of the body 11.

According to the invention, a constraint element 30 constrains the application member 20 such that the applicator part 22 extends in a direction Y forming an angle $\alpha$ with the axis X, this angle $\alpha$ being advantageously between 1 and 60°, better still between 10 and 30°, for example of the order of 20°.

Referring to FIGS. 2 and 3, it will be seen that the constraint element 30 has a tubular fitting part 31, for example with a cylindrical shape of revolution about an axis Z, which coincides with the axis X when the element 30 is in place on the application member 20.

The body 31 is continued in the distal direction by a bearing element 34, which extends in the direction of an axis W forming an angle $\beta$ with the axis Z. The bearing element 34 extends, for example, cylindrically about the axis W over a sector of angular extent of between 2 and 10°.

When the constraint element 30 is in place on the application member 20, the bearing element 34 will, with its inner face, constrain the application member 20 such that the applicator part is forced to incline.

The constraint element 30 can remain in place on the application member 20 by friction.

To produce the applicator, in the example in question, the constraint element 30 is engaged with force on the application member 20, this engagement taking place along the axis of the body 21, which coincides with the longitudinal axis of the application member 20 before the constraint element 30 is fitted.

For example, the constraint element 30 is inserted until it comes into abutment against the end of the body 11.

In the example in question, the attached element 30 is fitted without visible deformation thereof, with only the application member 20 deforming.

To use the applicator 10, the user brings the application member 20, especially the tip thereof, into contact with the skin, as is illustrated in FIG. 4.

The non-zero angle $\alpha$ between the longitudinal axis X of the body 11 and the axis Y of the applicator part 22 clears the view of the eyelid, allowing the person to apply makeup more easily while looking in a mirror.

In the example in FIGS. 1 to 5, the constraint element 30 is permanently fixed to the application member 20, since it is not intended to be moved relative to the application member 20 by the user.

Preferably, the constraint element 30 is fitted on the application member 20 before the applicator 10 is packaged, so that the user does not then have to worry about fitting the constraint element 30 on the application member 20.

Alternatively, the user is able to choose whether or not to fit the constraint element 30 on the application member 20. This affords the user the possibility of using the application member 20 without the constraint element 30, and with the applicator part 22 oriented in the longitudinal axis of the container.

If appropriate, the application member 20 can be produced with a shape that permits reversibility of the fitting of the constraint element 30 without damaging the application member 20.

Alternatively, the attached element 30 is fitted in such a way that it cannot easily be removed by the user, for example by comprising one or more teeth that are anchored in the application member 20 and that make it more difficult to remove the constraint element 30. These teeth are inclined so as not to impede the insertion of the element 30 on the application member 20 and so as to oppose the reverse movement.

The constraint element 30 can also be fitted relative to the application member 20 in such a way as to be movable between at least two configurations, in which the application member 20 is constrained to different degrees.

For example, as is illustrated in FIGS. 6A and 6B, the element 30 is fitted rotatably about the application member 20 so as to be able to adopt two configurations. In the first one, illustrated in FIG. 6A, the constraint element 30 does not constrain the application member 20, and the latter extends, for example, with the applicator part 22 in a direction parallel to the longitudinal axis X of the body 11.

The bearing element 34, in the first configuration, does not bear, or does not bear significantly, on the applicator part 22. In a second configuration, after rotation about the axis X of the base 21, the bearing element 34 will constrain the applicator part 22 more strongly, causing the latter to bend significantly and to orient itself in a direction Y forming an angle $\alpha$ with the axis X, as is illustrated in FIG. 6B.

It will be noted that, for this purpose, the application member 20 can have a shape without rotational symmetry about its longitudinal axis, which allows the bearing element 34 to engage in a recess 25 of the application member 20 in the configuration of FIG. 6A and, in the configuration of FIG. 6B, to bear on the applicator part 22, on the side opposite the recess 25.

FIG. 6A also illustrates the possibility of the constraint element 30 being fitted on the body 11 so as to be able to turn relative to the latter without moving axially. For example, in the end region 12, the pen body 11 has an annular groove 17 on which the tubular skirt 28 is snap-fitted.

In the variant in FIGS. 7A and 7B, the attached element 30 is movable, axially along the axis of the support, on the application member 20.

In the configuration of FIG. 7A, the bearing element 34 constrains the applicator part 22 to a lesser extent than in the configuration of FIG. 7B, in which the element 30 has moved closer to the body 11. To facilitate the bending of the applicator part 22, the application member 20 can be made, for example, with a narrowed transverse section 29 between the base and the applicator part, as illustrated.

FIG. 8 illustrates the possibility of producing the application member 20 with a shape of rotational symmetry prior to insertion in the attached element 30.

In FIG. 9, the constraint element 30 is carried by a guide 40 which is produced, for example, in one piece with a tubular skirt 41 that at least partially defines the reservoir containing the product. The guide 40 can be bent, as illustrated, it being possible for the constraint element 30 to have a rectilinear axis and rotational symmetry. It is the guide 40 which, by way of the constraint element 30, causes the application member 20 to curve. During assembly, the constraint element 30 can be inserted into the guide 40 when the application member 20 is already in place. Before the constraint element 30 is fitted, the application member 20 can already be forced to curve by the guide 40.

Needless to say, the invention is not limited to the examples that have just been described. In particular, the invention can be applied to application members other than felt tips, for example fine brushes or applicator endpieces made of foam or having a flocked core.

The invention can also be applied to application members such as mascara brushes produced by thermoplastic injection moulding.

The constraint element 30 can be movable relative to the application member 20 in a movement other than a purely axial movement or a purely rotational movement, for example in a helical movement, being screwed for example onto the application member 20 or the support of the latter.

If appropriate, the movement of the constraint element is controlled by an action of the user on a control member such as a push button or a slide.

The attached element 30 is preferably put in place without deforming, as has been described above.

Alternatively, the attached element 30 is made up of parts which are assembled on the application member, for example two parts which are fixed to each other by a snap-fit action, optionally connected by a hinge film, and which clamp the application member and constrain the latter by causing the applicator part to incline.

In an alternative not shown, the recess 25 is in the form of an annular groove of semi-circular cross section before deformation of the application member, that is to say with its longitudinal axis rectilinear.

The tip 22 can have a conical shape with an angle of between 10 and 20° at the vertex, in particular an angle equal to 15°, with a rounded end, especially of radius 0.1 mm.

The constraint element can be provided with at least one rib which, cooperating with the application member, helps hold it in place. Such a rib 100 has been illustrated schematically by broken lines in FIG. 3.

The expression "comprising a" should be understood as being synonymous with "comprising at least one".

The invention claimed is:

1. Cosmetic applicator comprising an application member having a base fixed to a support, this base extending along a longitudinal axis of the support, and an applicator part connected to the base, the applicator comprising a constraint element fitted to the application member and at least partially in contact with the application member, the constraint element constraining the application member in such a way that the applicator part extends at least partially obliquely with respect to the axis of the support, wherein the constraint element has a tubular fitting part continued in the distal direction by a bearing element extending in the direction of an axis forming an angle with the axis along which the tubular fitting part extends, said bearing element being configured to constrain, with its inner face, the application member such that the applicator part is forced to incline, when the constraint element is in place on the application member.

2. Applicator according to claim 1, the constraint element being carried exclusively by the application member.

3. Applicator according to claim 1, the constraint element being fixed at least partially to the support of the application member.

4. Applicator according to claim 1, the application member being a felt tip.

5. Applicator according to claim 1, the application member having a rectilinear longitudinal axis before the constraint element is fitted.

6. Applicator according to claim 1, the application member having a shape without rotational symmetry before the constraint element is fitted.

7. Applicator according to claim 1, the application member having a shape with rotational symmetry before the constraint element is fitted.

8. Applicator according to claim 1, the constraint element being fixed relative to the application member.

9. Applicator according to claim 1, the constraint element being movable relative to the application member.

10. Applicator according to claim 9, the movement of the constraint element relative to the application member taking place between at least two positions, in which the constraint element forms part of the applicator, conferring two different respective orientations on the applicator part.

11. Applicator according to claim 1, the constraint element being moulded in one piece from thermoplastic material.

12. Applicator according to claim 1, the axis of the applicator part forming an angle $\alpha$ of between 10 and 20° with the axis of the support.

13. Applicator according to claim 1, the constraint element being made in one piece with a tubular body forming a reservoir.

14. Applicator according to claim 1, the application member having a recess making it easier to bend the applicator part.

15. Applicator according to claim 1, the constraint element having at least one rib for helping to hold the application member.

16. Device for packaging and applying a cosmetic product, preferably eyeliner, having:

an applicator as defined in claim 1, a container containing the product to be applied with the aid of the applicator.

17. Device according to the preceding claim, the container being formed by a pen body carrying the application member.

18. Method for producing an applicator as defined in claim 1, comprising the step of deforming the application member with the aid of the constraint element in such a way as to cause the applicator part to extend in a direction other than the one in which it extends before the constraint element is fitted.

19. Cosmetic applicator comprising an application member having a base fixed to a support, this base extending along a longitudinal axis of the support, and an applicator part connected to the base, the applicator comprising a constraint element fitted to the application member and at least partially in contact with the application member, the constraint element constraining the application member in such a way that the applicator part extends at least partially obliquely with respect to the axis of the support, wherein the constraint element is inserted in a guide made in one piece with a tubular guide which at least partially defines a reservoir containing the product.

* * * * *